United States Patent [19]

Cousins

[11] 4,241,836

[45] Dec. 30, 1980

[54] UNIVERSAL RACKET RACK

[76] Inventor: Rebecca A. Cousins, 3744 Brookside Rd., Toledo, Ohio 43606

[21] Appl. No.: 51,401

[22] Filed: Jun. 25, 1979

[51] Int. Cl.[3] ..... A47F 7/00

[52] U.S. Cl. ..... 211/14; 211/71

[58] Field of Search ..... 211/14, 13, 60 R, 88, 211/71, 65, 66

[56] References Cited

U.S. PATENT DOCUMENTS

| | | | |
|---|---|---|---|
| 825,774 | 7/1906 | Stumm | 211/88 |
| 2,767,854 | 10/1956 | Barrett | 211/13 |
| 3,677,414 | 7/1972 | Rock | 211/13 |
| 3,858,725 | 1/1975 | Pietrack et al. | 211/13 |
| 4,002,241 | 1/1977 | Parrilla | 211/14 X |
| 4,108,312 | 8/1978 | Craven | 211/13 |
| 4,116,340 | 9/1978 | Nelson et al. | 211/13 |

FOREIGN PATENT DOCUMENTS

| | | | |
|---|---|---|---|
| 2451086 | 4/1976 | Fed. Rep. of Germany | 211/88 |
| 962004 | 11/1949 | France | 211/13 |

*Primary Examiner*—Roy D. Frazier
*Assistant Examiner*—Robert W. Gibson, Jr.
*Attorney, Agent, or Firm*—Allen D. Gutchess, Jr.

[57] ABSTRACT

A universal rack for tennis rackets, squash rackets, badminton rackets, paddle ball rackets, and racketball rackets is provided. The rack includes an elongate horizontal member having an elongate slot extending longitudinally thereof having an opening extending from one side of the slot to the adjacent edge of the elongate member. The rack includes a vertical plate extending downwardly from the other edge of the elongate member. Receptacles project from the plate on each side of a vertical line through the opening and are of a size to receive cans of tennis balls, or balls used in paddle ball, squash, or racketball, or birds used in badminton.

2 Claims, 2 Drawing Figures

UNIVERSAL RACKET RACK

This invention relates to a universal racket rack to hold rackets used in various sports.

Heretofore, in spite of the rising popularity in such sports using rackets as tennis and racketball, there has been no satisfactory storage rack for these rackets and balls or the like used in the sports.

The present invention provides a universal racket rack suitable for use with tennis rackets, squash rackets, badminton rackets, paddle ball rackets, racketball rackets, and the like. The rack includes an elongate, horizontal member having upper and lower parallel, planar surfaces and an elongate slot extending longitudinally of the elongate member and extending between the upper and lower surfaces. The slot has a length which is less than the width of the net frame of the smallest racket to be held, and an opening extends from one side of the slot to the adjacent edge of the elongate member through which the racket can be inserted into the slot. A vertical plate extends downwardly from the other edge of the elongate member and has provisions for affixing the rack to a wall or the like.

Two receptacles extend forwardly from the vertical plate a distance below the horizontal, elongate member. The receptacles are of a size sufficient to receive cans of tennis balls or the balls used in the other mentioned sports and badminton birds. The receptacles are located symmetrically with respect to the opening in the elongate member so that the handle of the racket will extend downwardly between the two receptacles when held in the slot.

The universal rack can be molded of plastic and used out doors, if desired, in which case drain openings can be incorporated into the receptacles. The universal rack can also be adapted for use with ping pong paddles and more than one slot for additional rackets can also incorporated into the horizontal elongate member.

It is, therefor, a principal object of the invention to provide a rack for holding a variety of rackets used in various sports.

Figure 1:
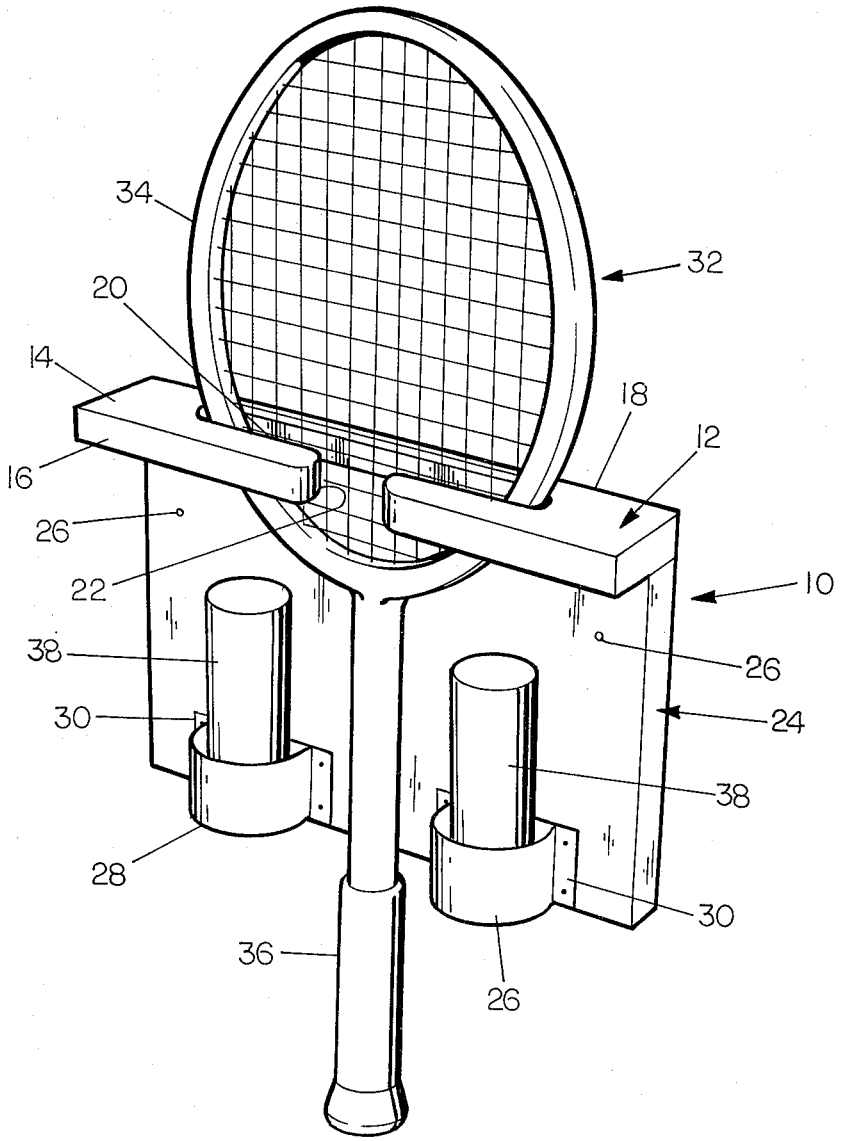
Figure 2:
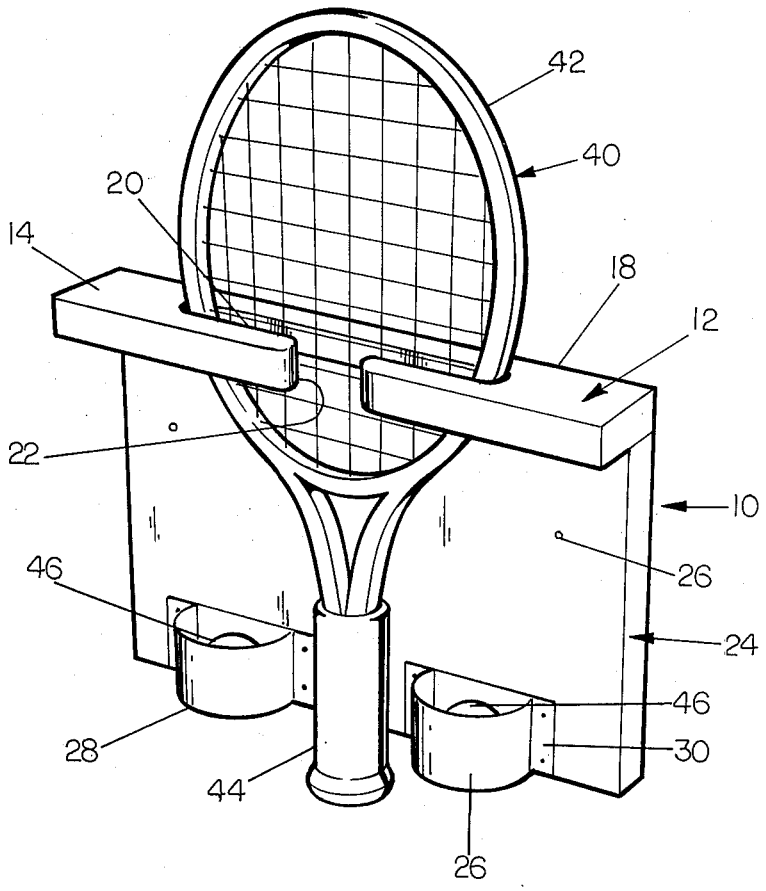

Many other objects and advantages of the invention will be apparent from the following detailed description of a preferred embodiment thereof, reference being made to the accompany drawings, in which:

FIG. 1 is somewhat schematic view in perspective of a universal racket rack holding a tennis racket and cans of tennis balls; and FIG. 2 is a similar view in perspective of the universal rack holding a racketball racket and balls.

Referring to the drawings, a universal racket rack according to the invention is indicated at 10. The rack can be made of wood or molded of plastic, by way of example. The rack includes a horizontal elongate member 12 having a length several times its width and a width several times its thickness. The member has upper and lower horizontal, planar surfaces 14 and front and rear longitudinally extending edges 16 and 18.

A slot 20 extends between the upper and lower surfaces 14 and also extends longitudinally of the elongate member 12, being substantially symmetrically located with respect thereto. The length of the slot is such as to be shorter that the transverse dimension of the smallest racket to be held by the rack 10. This length can be six to seven inches, preferably seven inches when the smallest racket to be held would be a racketball racket. The largest transverse dimension of a racketball racket is about eight inches with the same dimension of a tennis racket being about nine inches. An opening 22 extends from one longitudinal edge of the slot 20 to the front longitudinal edge 16 of the horizontal elongate member 12. Preferably, the opening is symmetrical with respect to the slot 20 and with respect to the elongate member 12.

A vertical plate 24 extends downwardly from the rear longitudinal edge 18 of the horizontal member 12, the plate 24 having holes 26 or other suitable provisions for fastening the rack to a wall or the like. The vertical plate 24 also has receptacles 26 and 28 extending forwardly thereof and located near the bottom edge so that cans of tennis balls can be placed therein. The receptacles are symmetrically located with respect to the opening 22 and the slot 20 so that a handle of a racket can extend downwardly there between. The receptacles can be attached to the plate 24 by mounting flanges 30 or can be structurally integral with the plate 24.

The universal rack 10 can be used with a wide variety of rackets used in various sports including tennis, squash, badminton, paddle ball, and racketball. In FIG. 1, a tennis racket 32 is shown held in the rack 10. The racket 32 has a net frame 34 located in the slot 20 with peripheral portions of the net frame contacting the ends of the slot 20. A handle 36 of the racket 32 extends downwardly below the horizontal member 12 and between the receptacles 26 and 28. The racket 32 is placed in the rack 10 by moving the upper portion of the handle 36 through the opening 22 and lowering the racket until the net frame 34 contacts both ends of the slot. The receptacles 26 and 28 are of a size large enough to receive cans 38 of three tennis balls and spaced below the horizontal member 12 a sufficient distance that the cans will clear it.

In FIG. 2, the universal rack 10 is shown with a racketball racket 40. The racket 40 includes a net frame 42 and a handle 44. Since the net frame 42 has a transverse dimension less than that of the tennis net frame 34, the racket 46 is lower in the slot 20. The receptacles 26 and 28 now receive racketball balls 46 with the receptacles being sufficiently large that the balls 46 can be grasped quite easily.

Various modifications of the above described embodiment of the invention will be apparent to those skilled in the art, and it is to be understood that such modifications can be made without departing from the scope of the invention if they are within the spirit and tenor of the accompanying claims.

I claim:

1. A universal rack for tennis rackets, squash rackets, badminton rackets, paddle ball rackets, and racketball rackets comprising an elongate horizontal member having a length exceeding its width and having two substantially parallel, planar upper and lower surfaces, an elongate slot extending longitudinally of said elongate member and extending between the upper and lower surfaces, said slot having a length less than the maximum transverse dimension across the net frame of the smallest racket to be held, said horizontal member also having an opening extending from one side of said slot to the adjacent edge of said elongate member, a vertical plate extending downwardly from the edge of said elongate member opposite the edge having the opening, and receptacles extending from said vertical plate and being symmetrically located with respect to said slot, said receptacles having substantially flat bottoms and being of sufficient size to receive cans of tennis balls held uprightly, and said receptacles being spaced substantially below said elongate member so that the cans will not interfere therewith.

2. In combination, a universal rack for tennis rackets, squash rackets, badminton rackets, paddle ball rackets, and racketball rackets comprising an elongate horizontal member having a length exceeding its width and a width exceeding its thickness and having two substantially parallel, planar upper and lower surfaces, an elongate slot extending longitudinally of said horizontal member and extending between the upper and lower surfaces, said slot having a length less than the maximum transverse dimension across the net frame of the smallest racket to be held, said elongate member also having an opening extending from the center of one side of said slot to the adjacent edge of said elongate member, a vertical plate extending downwardly from the edge of said elongate member opposite the edge having the opening, and receptacles of generally D-shaped configurations projecting from said plate, having substantially flat bottoms and spaced substantially below said elongate member to be capable of receiving cans of tennis balls and racketball balls, said receptacles being symmetrically located with respect to said slot and said opening, and a racket having a net frame portion held in said slot with the edges of the frame contacting the ends of said slot and a handle extending downwardly between said receptacles.

* * * * *